US011661939B2

(12) United States Patent
Iwai et al.

(10) Patent No.: US 11,661,939 B2
(45) Date of Patent: May 30, 2023

(54) ROTARY COMPRESSOR HAVING RECIPROCATOR AND SUPPORT

(71) Applicant: DAIKIN INDUSTRIES, LTD., Osaka (JP)

(72) Inventors: Yudai Iwai, Osaka (JP); Takuya Ishino, Osaka (JP); Masahide Higuchi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/692,016

(22) Filed: Mar. 10, 2022

(65) Prior Publication Data

US 2022/0299029 A1 Sep. 22, 2022

(30) Foreign Application Priority Data

Mar. 18, 2021 (JP) ..... JP2021-044527

(51) Int. Cl.

| | |
|---|---|
| ***F04C 23/00*** | (2006.01) |
| ***F04C 29/02*** | (2006.01) |
| ***F04C 18/04*** | (2006.01) |
| ***F04C 2/44*** | (2006.01) |
| ***F04C 18/32*** | (2006.01) |
| ***F04C 18/356*** | (2006.01) |

(52) U.S. Cl.

CPC ..... *F04C 23/008* (2013.01); *F04C 18/356* (2013.01); *F04C 29/028* (2013.01); *F04C 2210/261* (2013.01)

(58) Field of Classification Search

CPC ..... F04C 18/356; F04C 23/008; F04C 18/32; F04C 18/045; F04C 29/02

See application file for complete search history.

(56) References Cited

U.S. PATENT DOCUMENTS

2015/0240815 A1 8/2015 Inada et al.
2017/0275996 A1* 9/2017 Cho ..... F01C 21/0809

FOREIGN PATENT DOCUMENTS

| | | | |
|---|---|---|---|
| JP | 2008-45415 | A | 2/2008 |
| JP | 4547978 | B2 | 7/2010 |
| JP | 5413493 | B1 | 11/2013 |
| JP | 2014-37813 | A | 2/2014 |

* cited by examiner

*Primary Examiner* — Deming Wan
(74) *Attorney, Agent, or Firm* — Global IP Counselors, LLP

(57) ABSTRACT

A rotary compressor includes a casing including an oil reservoir configured to store lubricating oil inside, and a compression mechanism including a reciprocator and a support. The reciprocator defines a compression chamber and reciprocating along a first direction. The support has a support surface configured to support the reciprocator. The support surface includes a first groove and a second groove formed therein. The first groove extends along a second direction intersecting with the first direction and is configured to transfer the lubricating oil to the second groove. The second groove extends from a center of the first groove toward the compression chamber along the first direction.

18 Claims, 8 Drawing Sheets

ROTARY COMPRESSOR HAVING RECIPROCATOR AND SUPPORT

CROSS-REFERENCE TO RELATED APPLICATIONS

This application claims priority to Japanese Patent Application No. 2021-044527, filed on Mar. 18, 2021. The entire disclosures of Japanese Patent Application No. 2021-044527 is incorporated by reference herein.

BACKGROUND

Technical Field

The present disclosure relates to a rotary compressor having a reciprocator and a support, and an air conditioner using such a rotary compressor.

Background Information

A rotary compressor disclosed in Japanese Patent No. 5413493 has a compression mechanism. The compression mechanism includes a piston that revolves, a vane (which may be referred to as a blade) that is integrally formed with the piston and reciprocates, and a bush that supports the vane. The bush is provided with a groove for retaining lubricating oil.

SUMMARY

A rotary compressor according to one aspect includes a casing and a compression mechanism. The casing includes an oil reservoir that stores lubricating oil therein. The compression mechanism includes a reciprocator and a support. The reciprocator defines a compression chamber. The reciprocator reciprocates along a first direction. The support has a support surface. The support surface supports the reciprocator. The support surface is provided with a first groove and a second groove. The first groove extends along a second direction intersecting the first direction. The first groove transfers the lubricating oil to the second groove. The second groove extends from a center of the first groove toward the compression chamber along the first direction.

In this configuration, the first groove conveys the lubricating oil to a center of the support in the second direction. Next, the second groove spreads the lubricating oil conveyed to the center in the first direction of the support. Therefore, the center of the support acquires a large amount of lubricating oil, and thus seizure at the center of the support is suppressed.

DETAILED DESCRIPTION OF EMBODIMENT(S)

First Embodiment (1) Overall Configuration

Figure 1:
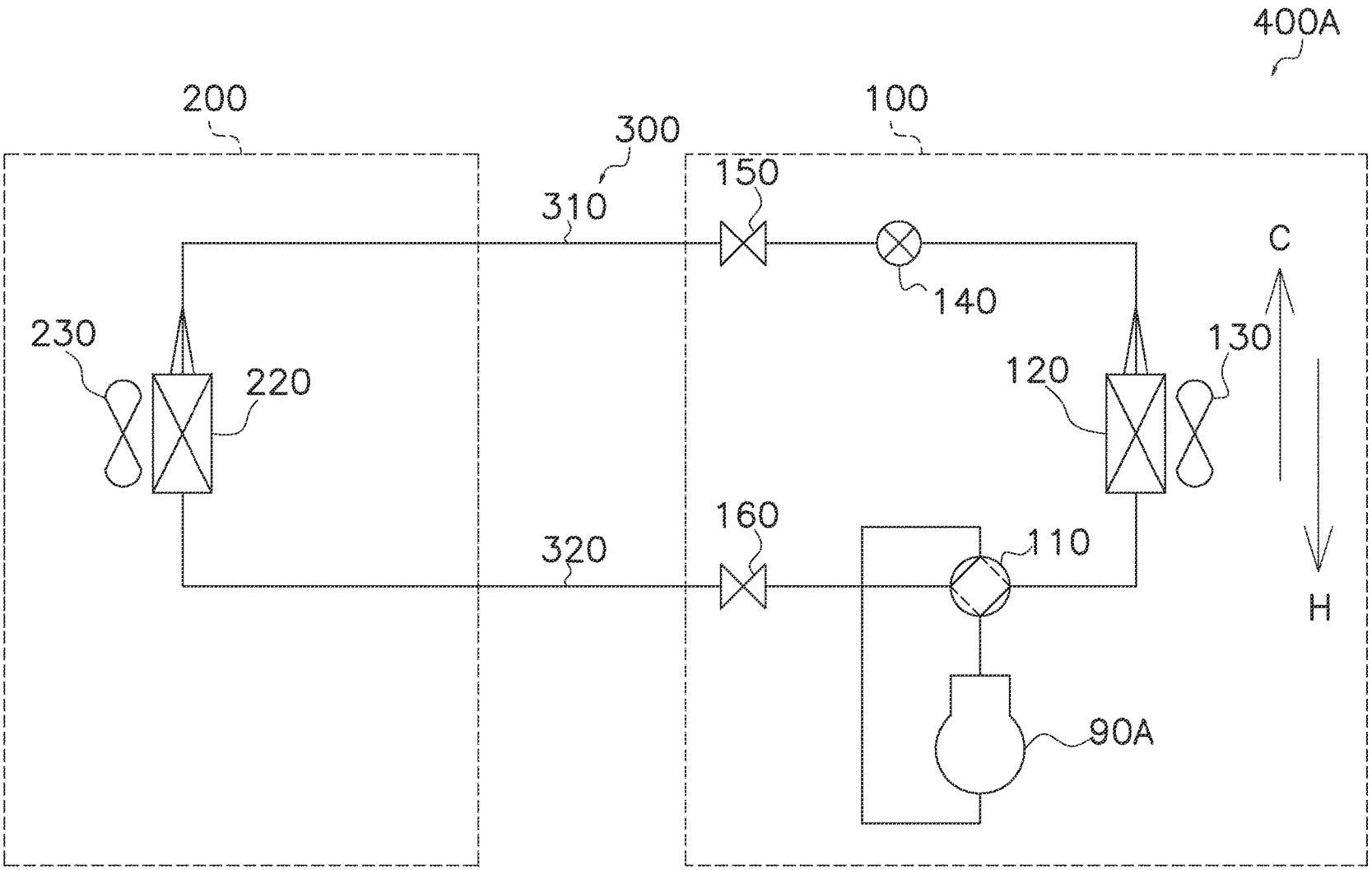
FIG. 1 is a circuit diagram of an air conditioner 400A according to a first embodiment.

FIG. 1 shows an air conditioner 400A according to a first embodiment. The air conditioner 400A includes an outdoor unit 100, an indoor unit 200, and a connection piping 300.

The outdoor unit 100 includes a rotary compressor 90A, a four-way switching valve 110, an outdoor heat exchanger 120, an outdoor fan 130, an outdoor expansion valve 140, a liquid shutoff valve 150, and a gas shutoff valve 160.

The indoor unit 200 includes an indoor heat exchanger 220 and an indoor fan 230.

The connection piping 300 includes a liquid connection pipe 310 and a gas connection pipe 320.

When the air conditioner 400A performs a cooling operation, the four-way switching valve 110 forms a connection indicated by a solid line in FIG. 1, and a refrigerant circulates in a direction of arrow C. In the cooling operation, the indoor heat exchanger 220 functions as an evaporator and provides cold air to a user in cooperation with the indoor fan 230. When the air conditioner 400A performs a heating operation, the four-way switching valve 110 forms a connection indicated by a broken line in FIG. 1, and the refrigerant circulates in a direction of arrow H. In the heating operation, the indoor heat exchanger 220 functions as a condenser and provides warm air to the user in cooperation with the indoor fan 230.

(2) Detailed Configuration of Rotary Compressor 90A

Figure 2:
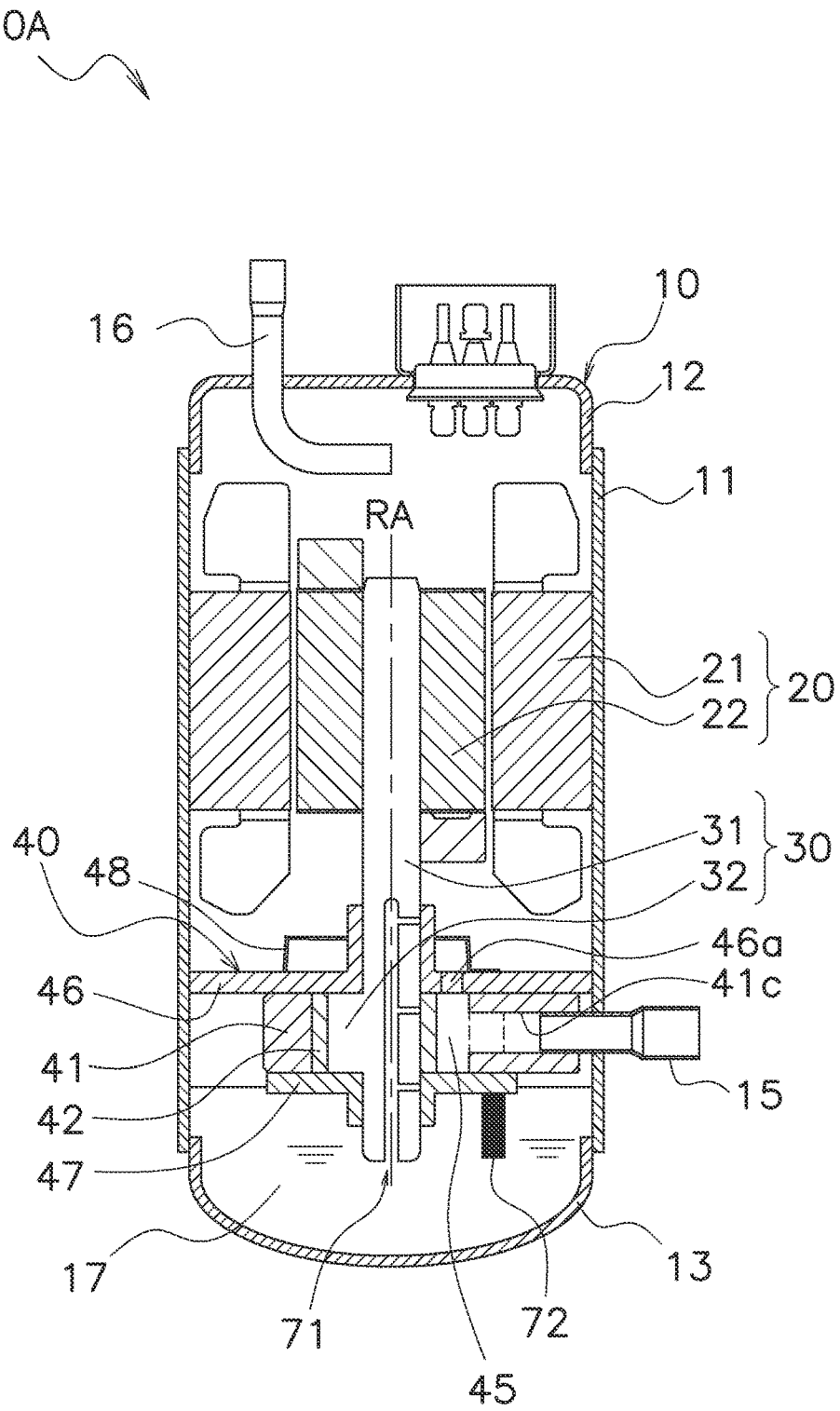
FIG. 2 is a sectional view taken along a vertical plane of a rotary compressor 90A.

FIG. 2 shows the rotary compressor 90A. The rotary compressor 90A sucks a low-pressure gas refrigerant and compresses the sucked low-pressure gas refrigerant to generate a high-pressure gas refrigerant. The rotary compressor 90A includes a casing 10, a suction pipe 15, a discharge pipe 16, a motor 20, a crank shaft 30, a compression mechanism 40, a first oil supply mechanism 71, and a second oil supply mechanism 72.

(2-1) Casing 10, Suction Pipe 15, and Discharge Pipe 16

The casing 10 accommodates various constituent elements of the rotary compressor 90A, the refrigerant, and the lubricating oil. The casing 10 includes a body 11, a lid 12, and a bottom 13 that are airtightly connected.

The suction pipe 15 for sucking the low-pressure gas refrigerant is attached to the body 11. The discharge pipe 16 for discharging the high-pressure gas refrigerant is attached to the body 11.

Inside the casing 10, there is an oil reservoir 17 that stores the lubricating oil. The oil reservoir 17 is located near the bottom 13.

(2-2) Motor 20

The motor 20 receives electric power supply from outside of the rotary compressor 90A and generates power for driving the compression mechanism 40. The motor 20 is attached to the body 11. The motor 20 includes a stator 21 and a rotor 22.

The stator 21 has a cylindrical shape and is fixed to the body 11. The stator 21 converts electric power into an AC magnetic field.

The rotor 22 is disposed inside the stator 21. The rotor 22 rotates by interacting with the AC magnetic field generated by the stator 21.

(2-3) Crank Shaft 30

The crank shaft 30 is fixed to the rotor 22 to rotate about a rotation axis RA with the rotor 22. The crank shaft 30 transmits a rotary force generated by the rotor 22 to the compression mechanism 40.

The crank shaft 30 includes a main shaft 31 concentric with the rotation axis RA and an eccentric portion 32 eccentric with the rotation axis RA. A part of the main shaft 31 is fixed to the rotor 22. The eccentric portion 32 is located in the compression mechanism 40.

(2-4) Compression Mechanism 40

The compression mechanism 40 compresses a low-pressure gas refrigerant to generate a high-pressure gas refrigerant. The compression mechanism 40 includes a cylinder 41, a piston 42, a vane 43, a front head 46, a rear head 47, a muffler 48, and a pair of bushes 49A.

Figure 3:
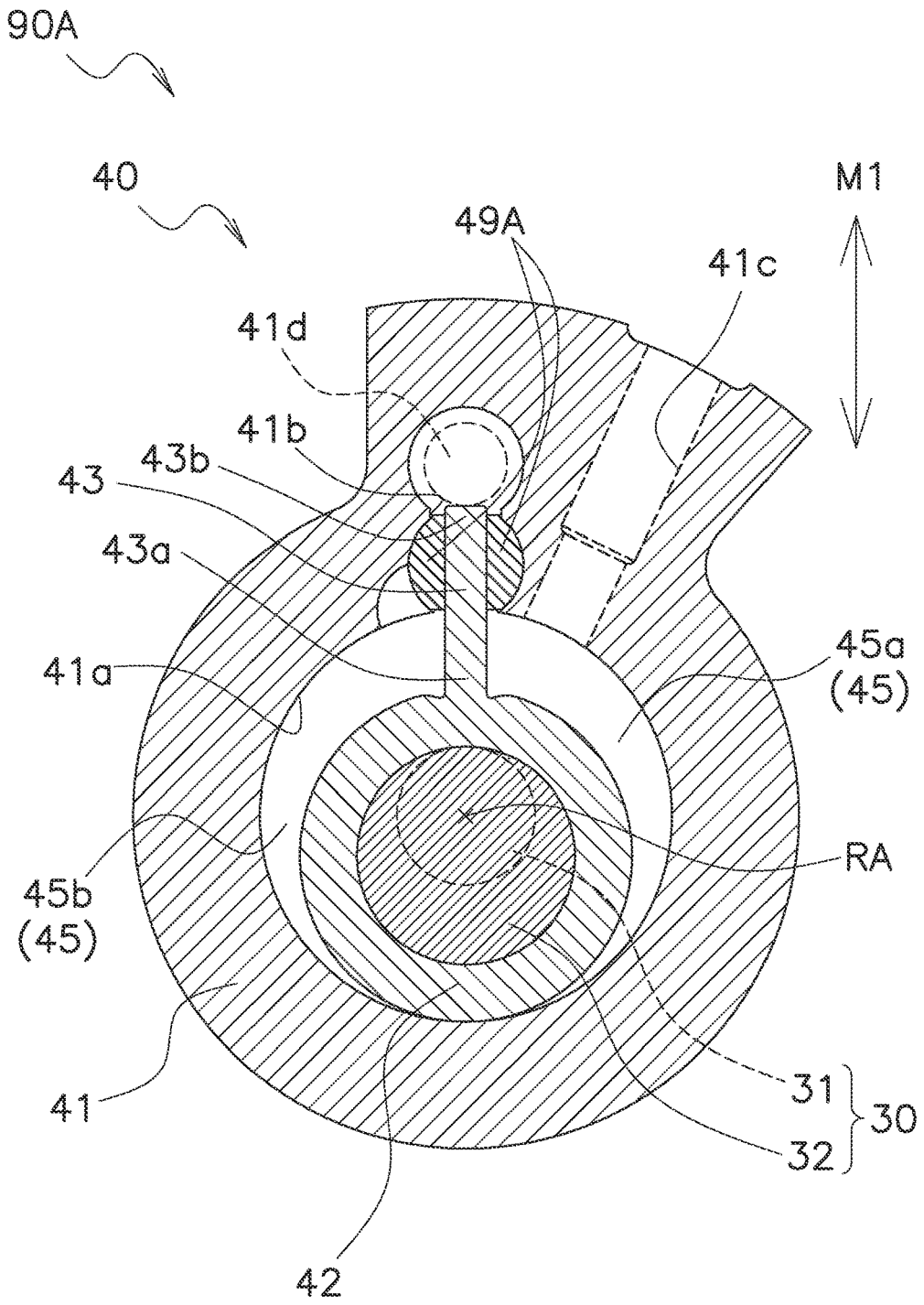
FIG. 3 is a sectional view taken along a horizontal plane of a compression mechanism 40.

FIG. 3 is a sectional view of the compression mechanism 40. The cylinder 41 is a rigid component. The cylinder 41 is provided with a first cavity 41*a*, a second cavity 41*b*, and a suction port 41*c*. The first cavity 41*a* and the second cavity 41*b* are connected to each other. The suction port 41*c* is for taking in a high-pressure gas refrigerant, and is connected to the suction pipe 15.

The piston 42 is a cylindrical member. The eccentric portion 32 is attached to a cavity of the piston 42. The rotation of the crank shaft 30 causes the piston 42 to revolve while being in contact with the cylinder 41.

The vane 43 is a plate-shaped member. The vane 43 is formed integrally with the piston 42.

Each of the pair of bushes 49A is a semicircular columnar member. The pair of bushes 49A are disposed on different sides of the vane 43 in order to support the vane 43.

The piston 42 is accommodated in the first cavity 41*a* of the cylinder 41. The vane 43 and the pair of bushes 49A are accommodated in the second cavity 41*b* of the cylinder 41.

A part of the second cavity 41*b* accommodating the vane 43 is a vane rear space 41*d*. The vane 43 has a first end 43*a* and a second end 43*b*. The first end 43*a* faces the first cavity 41*a*. The second end 43*b* is opposite the first end 43*a* and faces the vane rear space 41*d*.

The vane 43 reciprocates substantially in a first direction M1. That is, when the piston 42 moves away from the second cavity 41*b*, the vane 43 protrudes from the second cavity 41*b*. Meanwhile, when the piston 42 approaches the second cavity 41*b*, the vane 43 retreats to the second cavity 41*b*.

The vane 43 defines the compression chamber 45 in cooperation with the cylinder 41 and the piston 42. The compression chamber 45 is a space surrounded by the cylinder 41, the piston 42, and the vane 43 in contact with each other. The compression chamber 45 includes a first compression chamber 45*a* and a second compression chamber 45*b*. The first compression chamber 45*a* increases in volume as the crank shaft 30 rotates. The first compression chamber 45*a* is used to suck the low-pressure gas refrigerant. The second compression chamber 45*b* decreases in volume as the crank shaft 30 rotates. The second compression chamber 45*b* is used to increase a pressure of the refrigerant.

In FIG. 2 again, the front head 46 closes an upper surface of the cylinder 41. The front head 46 is provided with a discharge port 46*a* for discharging the high-pressure gas refrigerant from the compression chamber 45. The front head 46 has a large diameter. The front head 46 is fixed to the body 11 of the casing 10. As a result, the compression mechanism 40 as a whole is fixed to the casing 10. The rear head 47 closes a lower surface of the cylinder 41. The muffler 48 is attached to the front head 46 so as to cover the discharge port 46*a*. The muffler 48 reduces noise caused by pulsation of the pressure of the high-pressure gas refrigerant discharged from the discharge port 46*a*.

(2-5) First Oil Supply Mechanism 71 and Second Oil Supply Mechanism 72

The first oil supply mechanism 71 and the second oil supply mechanism 72 supply the lubricating oil in the oil reservoir 17 to the compression mechanism 40. At least one of the first oil supply mechanism 71 or the second oil supply mechanism 72 supplies part of the lubricating oil to the vane rear space 41*d*. The lubricating oil in the vane rear space 41*d* is used for lubricating the vane 43 and the bushes 49A.

(3) Detailed Configuration of Bushes 49A

Figure 4:
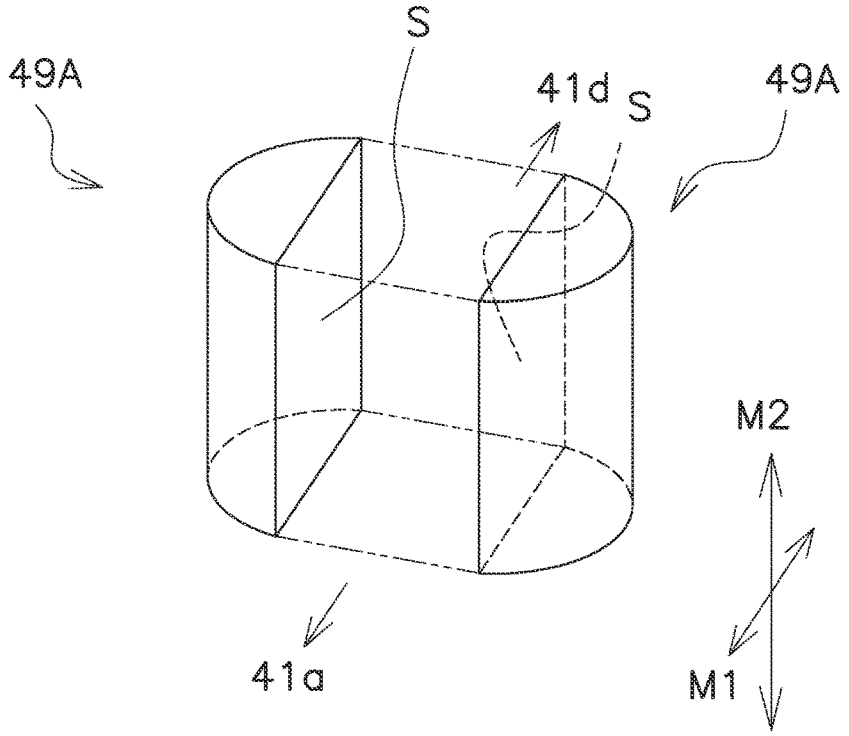
FIG. 4 is a perspective view of a pair of bushes 49A.

FIG. 4 is a perspective view of the pair of bushes 49A. Each of the bushes 49A has a support surface S that supports the vane 43. The support surface S is parallel to both the first direction M1 and a second direction M2. The second direction M2 intersects with the first direction M1.

Figure 5:
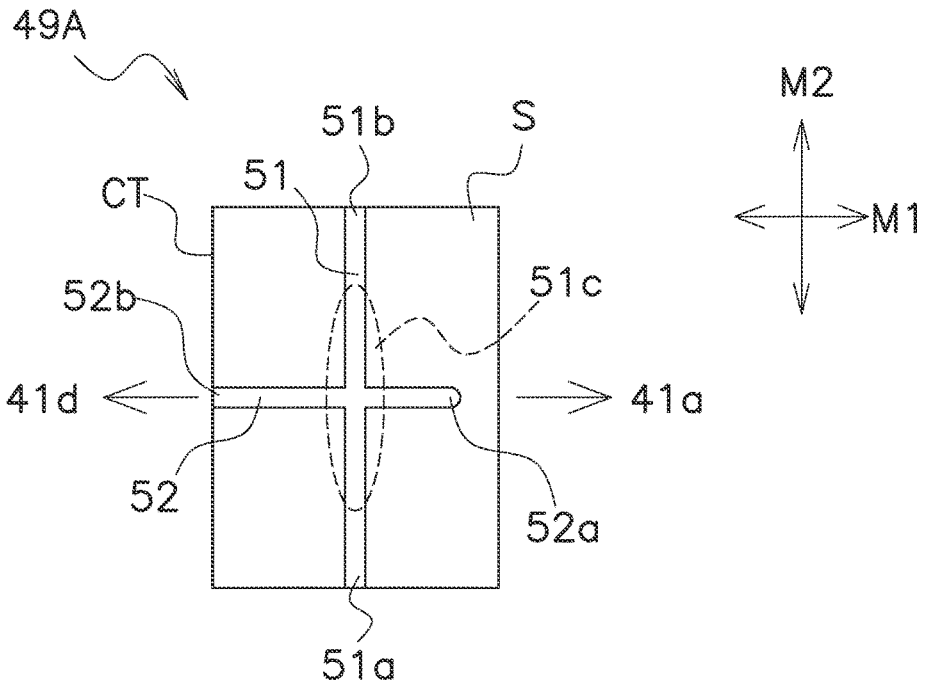
FIG. 5 is a side view of one bush 49A.

As shown in FIG. 5, the support surface S is provided with a first groove 51 and a second groove 52. The first groove 51 extends along the second direction M2. The first groove 51 has a first end 51*a*, a second end 51*b*, and a center 51*c*. Both the first end 51*a* and the second end 51*b* reach a contour CT of the support surface S.

The first groove 51 conveys the lubricating oil acquired at the first end 51*a* and the second end 51*b* toward the center 51*c*. Further, the first groove 51 transfers the acquired lubricating oil to the second groove 52.

The second groove 52 has a third end 52*a* and a fourth end 52*b*. The third end 52*a* is closer to the compression chamber 45 than the fourth end 52*b*. The fourth end 52*b* is farther from the compression chamber 45 than the third end 52*a*. The second groove 52 passes through the center 51*c* of the first groove 51. The second groove 52 extends from the center 51*c* toward the first cavity 41*a*, that is, toward the compression chamber 45 along the first direction M1. The third end 52*a* is separated from the contour CT of the support surface S. The fourth end 52*b* reaches the contour CT of the support surface S. The second groove 52 acquires lubricating oil from the fourth end 52*b*. The second groove 52 also acquires lubricating oil from the first groove 51 in the center 51*c*. The lubricating oil acquired by the second groove 52 is at least partially conveyed to the third end 52*a*.

(4) Dimensions

Figure 6:
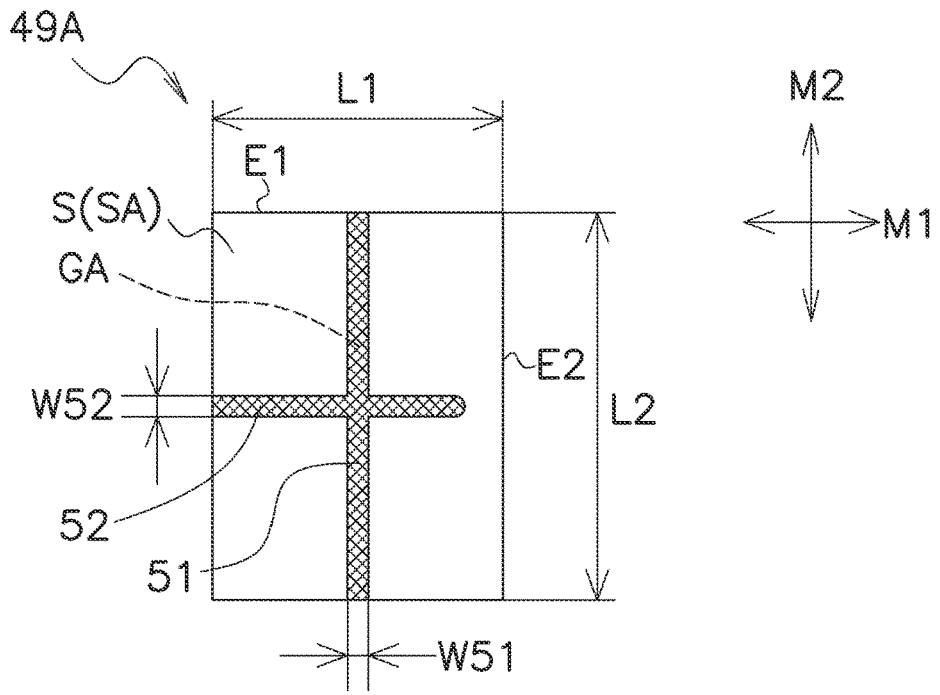
FIG. 6 is a side view of one bush 49A.

As is described with reference to FIG. 6, an amount of lubricating oil contributing to lubrication of the bushes 49A can be secured by setting dimensions of each part as follows, for example.

A width W51 of the first groove 51 is 1/20 or more of a length L1 of a side E1 of the support surface S extending in the first direction M1, or a width W52 of the second groove 52 is 1/40 or more of a length L2 of a side E2 of the support surface S extending in the second direction M2.

The first groove 51 and the second groove 52 have an area GA on the support surface S, the area GA being 1/50 or more of an area SA of the support surface S.

(5) Characteristics (5-1)

The first groove 51 conveys the lubricating oil to a center of the hush 49A in the second direction M2. Next, the second groove 52 spreads the lubricating oil conveyed to the center in the first direction M1 of the hush 49A. Therefore, the center of the hush 49A acquires a large amount of lubricating oil, and thus seizure in the center of the bush 49A is suppressed.

(5-2)

Both the first end 51*a* and the second end 51*b* of the first groove 51 reach the contour CT of the support surface S. Therefore, the first groove 51 can acquire the lubricating oil at both ends of the bush 49A, that is, on a side of the first cavity 41*a*, and on a side of the vane rear space 41*d*.

(5-3)

The third end 52*a* of the second groove 52 is separated from the contour CT of the support surface S. Therefore, the lubricating oil acquired in the center of the bush 49A is prevented from being discharged toward the compression chamber 45 through the second groove 52.

(5-4)

A ratio of the width W51 of the first groove 51 to the side E1 of the support surface S is 1/20 or more, or a ratio of the width W52 of the second groove 52 to the side E2 of the support surface S is 1/40 or more. Therefore, a predetermined ratio of dimension is involved in lubrication, and thus a degree of lubrication of the bush 49A further increases.

(5-5)

A ratio of the area GA constituted by the first groove 51 and the second groove 52 to the area SA of the support surface S is 1/50 or more. Therefore, a predetermined ratio of area is involved in lubrication, and thus the degree of lubrication of the bush 49A further increases.

(5-6)

The vane 43 is formed integrally with the piston 42. Lubrication of the vane 43 moving simultaneously with the piston 42 is thus ensured.

(5-7)

Since seizure inside the rotary compressor 90A is suppressed, a product life of the air conditioner 400A is improved.

(6) Modifications (6-1) First Modification of First Embodiment

Figure 7:
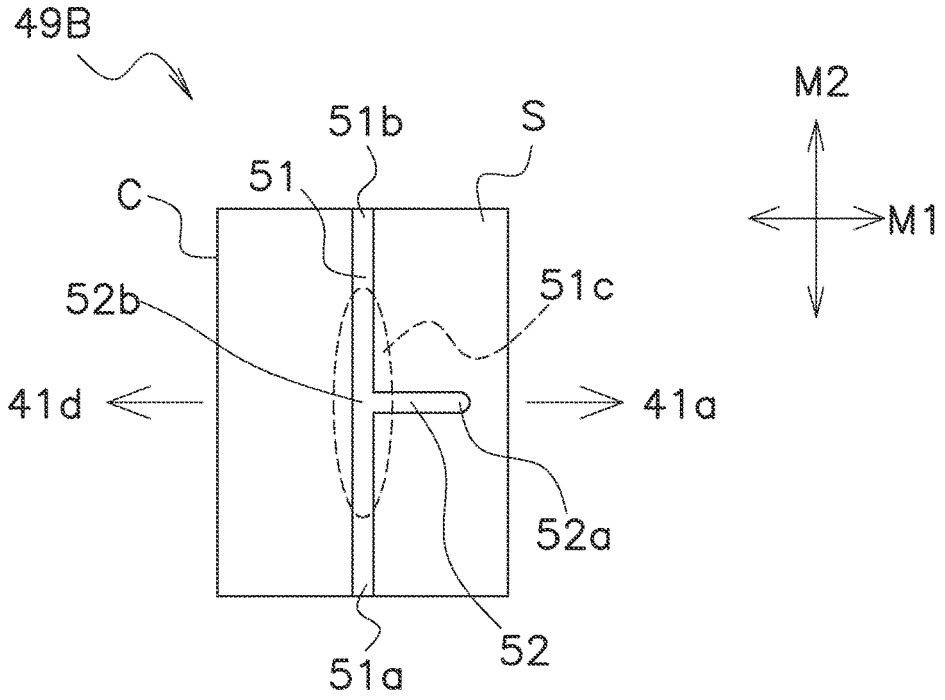
FIG. 7 is a side view of a bush 49B of a compressor according to a first modification of the first embodiment.

In the bush 49A according to the first embodiment, the fourth end 52*b* of the second groove 52 reaches the contour CT of the support surface S. Alternatively, as can be seen in a bush 49B shown in FIG. 7, the fourth end 52*b* may be separated from the contour CT of the support surface S. For example, the fourth end 52*b* of the second groove 52 is disposed in the center 51*c* of the first groove 51.

In this configuration, the second groove 52 also has a function of retaining the lubricating oil at a center of the bush 49B, and thus seizure at the center of the hush 49B is suppressed.

(6-2) Second Modification of First Embodiment

Figure 8:
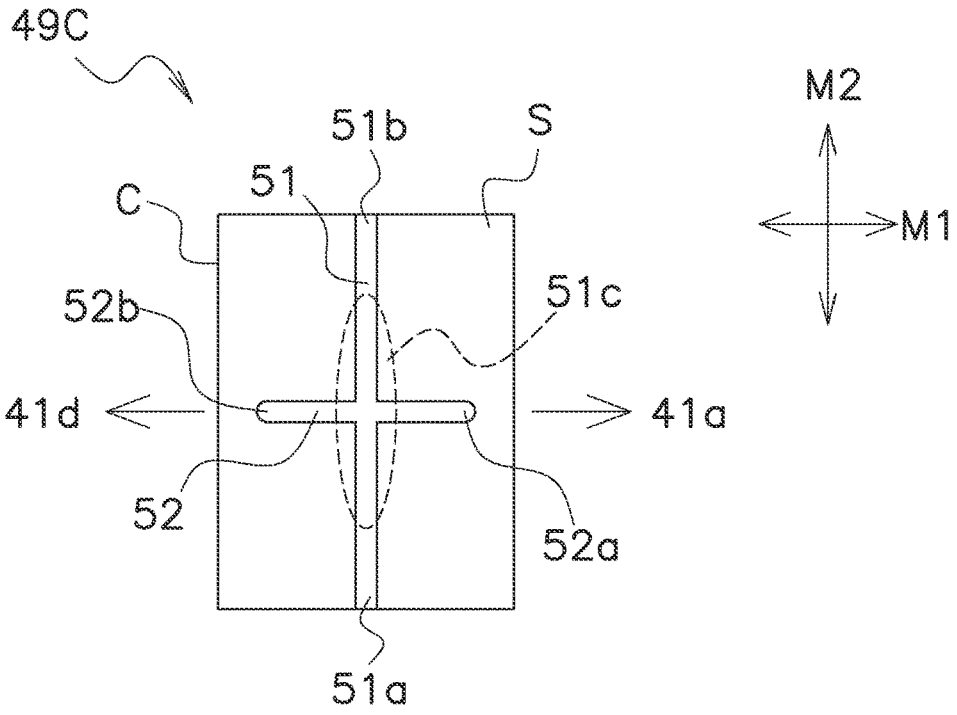
FIG. 8 is a side view of a hush 49C of a compressor according to a second modification of the first embodiment.

In the bush 49A according to the first embodiment, the fourth end 52*b* of the second groove 52 reaches the contour CT of the support surface S. Alternatively, as can be seen in a bush 49C shown in FIG. 8, the fourth end 52*b* may be separated from the contour CT of the support surface S. For example, the fourth end 52*b* of the second groove 52 is disposed between the contour CT on the side of the vane rear space 41*d* and the center 51*c* of the first groove 51.

In this configuration, the second groove 52 also has a function of retaining the lubricating oil in a center of the bush 49C, and thus seizure at the center of the bush 49C is suppressed.

(6-3) Third Modification of First Embodiment

Figure 9:
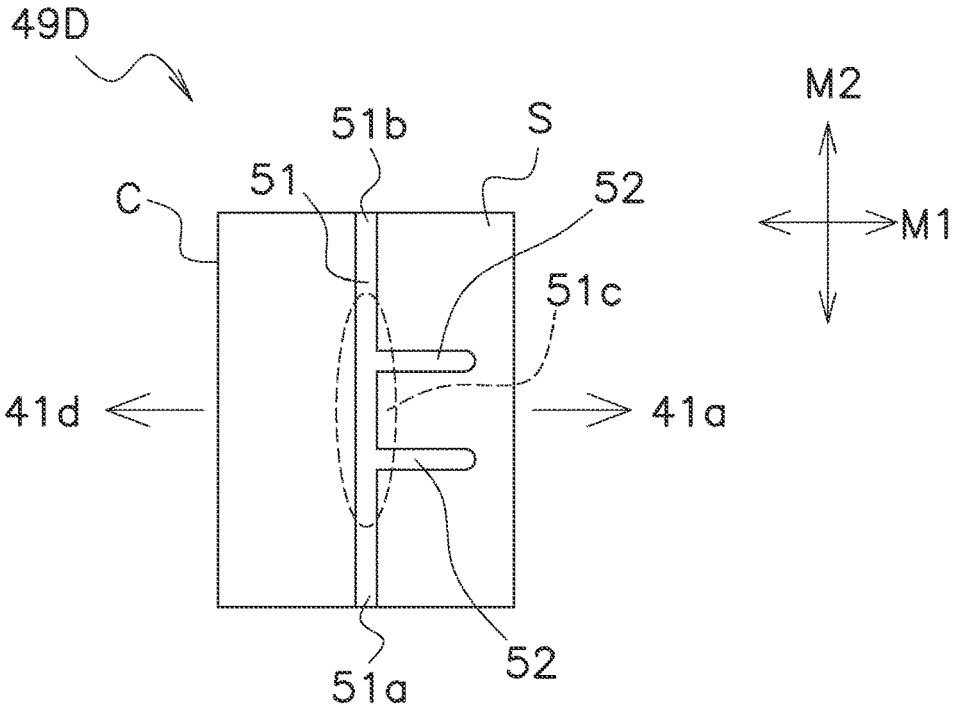
FIG. 9 is a side view of a hush 49D of a compressor according to a third modification of the first embodiment.

In the bush 49A according to the first embodiment, the support surface S is provided with one second groove 52. Alternatively as can be seen in a bush 49D shown in FIG. 9, the support surface S may be provided with a plurality of second grooves 52.

In this configuration, the plurality of second grooves 52 are disposed in the center of the bush 49D. Therefore, the center receives supply of the lubricating oil from each of the plurality of second grooves 52, and thus more amount of lubricating oil is supplied to the center.

(6-4) Fourth Modification of First Embodiment

Figure 10:
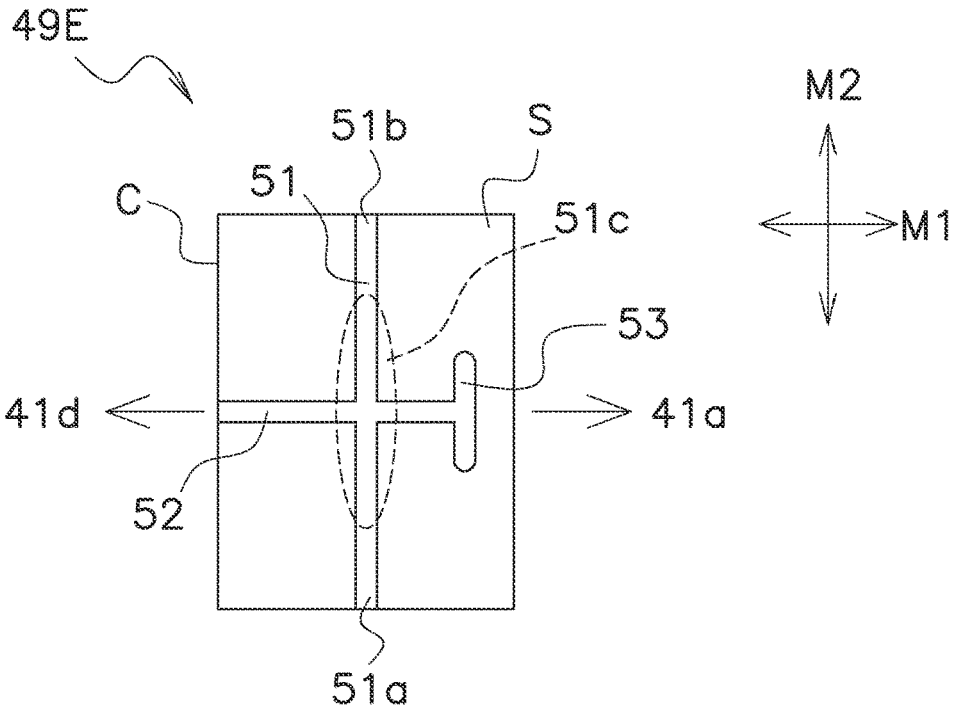
FIG. 10 is a side view of a bush 49E of a compressor according to a fourth modification of the first embodiment.

In the bush 49A according to the first embodiment, the support surface S is provided with the first groove 51 and the second groove 52. Alternatively, as can be seen in a bush 49E shown in FIG. 10, the support surface S may be further provided with a branch groove 53 extending from the third end 52*a* of the second groove 52 in the second direction M2.

In this configuration, the branch groove 53 is provided in a center of the bush 49E. Therefore, the branch groove 53 further increases the degree of lubrication in the center.

(6-5) Fifth Modification of First Embodiment

Figure 11:
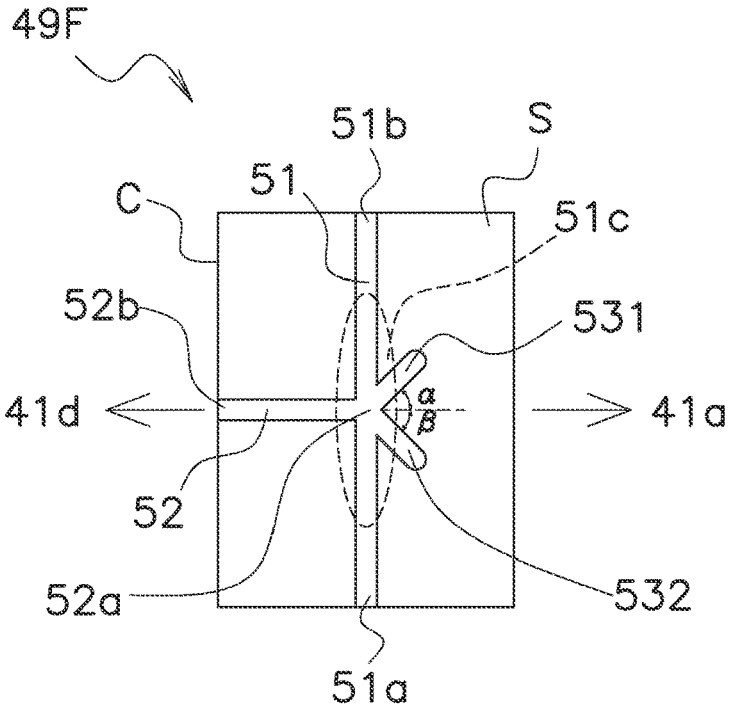
FIG. 11 is a side view of a bush 49F of a compressor according to a fifth modification of the first embodiment.

In the hush 49A according to the first embodiment, the support surface S is provided with the first groove 51 and the second groove 52. Alternatively, as can be seen in a bush 49F shown in FIG. 11, a first branch groove 531 and a second branch groove 532 may extend from the third end 52*a* of the second groove 52 on the support surface S. Here, the first branch groove 531 extends in a direction intersecting the first direction M1. The second branch groove 532 extends in a direction intersecting the first direction M1 and being different from the direction in which the first branch groove 531 extends. The first direction M1 and the first branch groove 531 form an acute angle $\alpha$. The first direction M1 and the second branch groove 532 form an acute angle $\beta$.

In this configuration, the first direction M1 in which the second groove 52 extends forms the acute angles $\alpha$ and $\beta$ with the first branch groove 531 or the second branch groove 532. Therefore, the first branch groove 531 and the second branch groove 532 spread the lubricating oil in both the first direction M1 and the second direction M2, and thus the degree of lubrication of the bush 49F further increases.

Second Embodiment (1) Configuration

Figure 12:
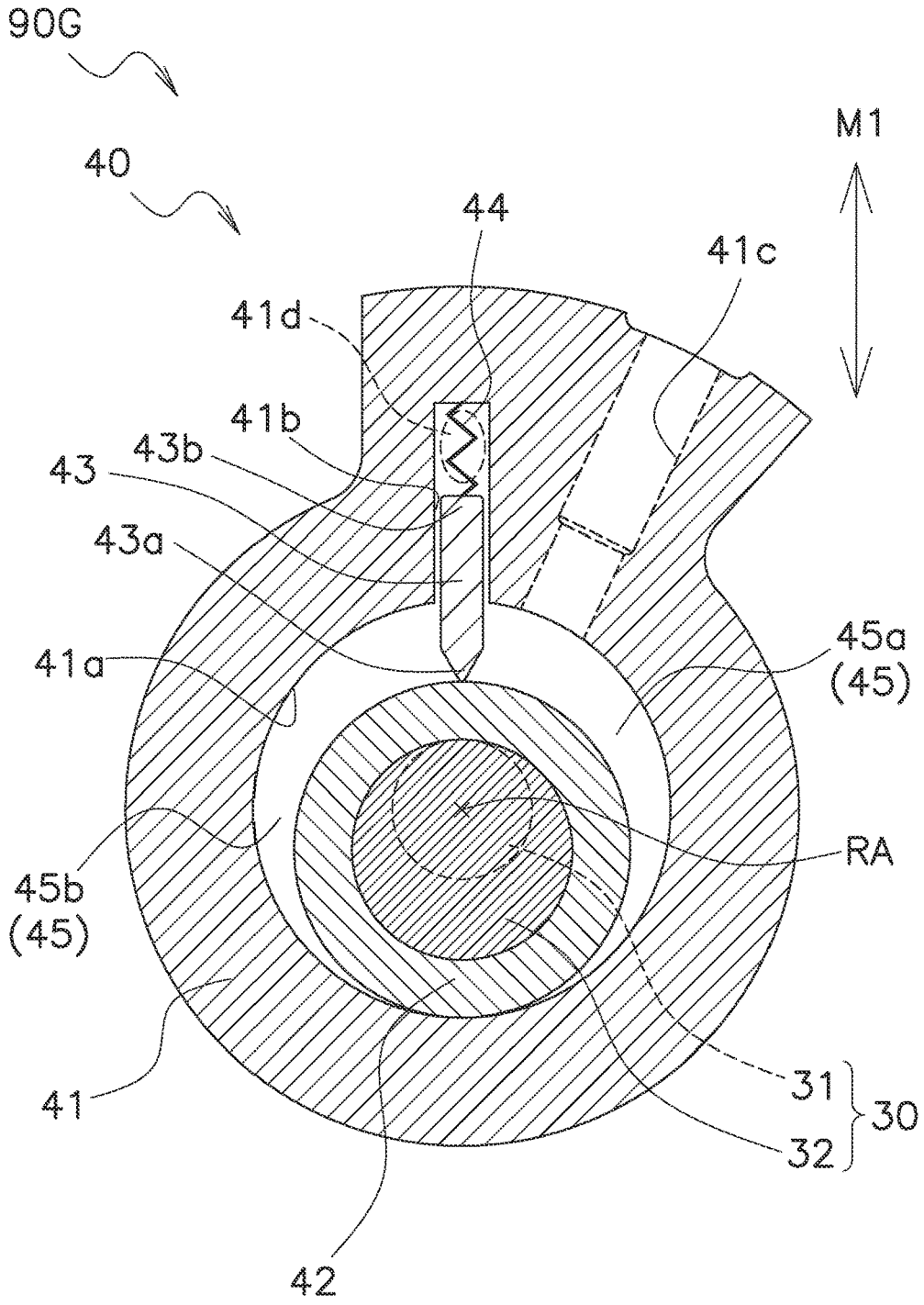
FIG. 12 is a sectional view of the compression mechanism 40 of a rotary compressor 90G according to a second embodiment.

FIG. 12 shows the compression mechanism 40 of a rotary compressor 90G mounted in an air conditioner according to a second embodiment. The air conditioner according to the second embodiment has the same configuration as the air conditioner 400A according to the first embodiment except that the rotary compressor 900 is mounted instead of the rotary compressor 90A.

The compression mechanism 40 of the rotary compressor 90G is different from the compression mechanism 40 according to the first embodiment in that the vane 43 is formed separately from the piston 42. A part of the second cavity 41*b* accommodating the vane 43 is a vane rear space 41*d*. A spring 44 is installed in the vane rear space 41*d*. The spring 44 brings the vane 43 into contact with the piston 42 by pushing the vane 43 toward the first cavity 41*a*.

In the rotary compressor 90A according to the first embodiment, the bush 49A has the support surface S, the first groove 51, and the second groove 52. On the other hand, in the rotary compressor 90G according to the second embodiment, the support surface S, the first groove 51, and the second groove 52 are formed on an inner wall of the second cavity 41*b* of the cylinder 41.

(2) Characteristics

The vane 43 is formed separately from the piston 42. Lubrication of the vane 43 moving independently from the piston 42 is thus ensured.

(3) Modifications

Any one of the modifications of the first embodiment may be applied to the second embodiment.

Conclusion

The embodiments of the present disclosure have been described above. Various modifications to modes and details should be available without departing from the object and the scope of the present disclosure recited in the claims.

The invention claimed is:

1. A rotary compressor comprising:

a casing including an oil reservoir configured to store lubricating oil inside; and a compression mechanism including a reciprocator and a support, the reciprocator defining a compression chamber and reciprocating along a first direction, the support having a support surface configured to support the reciprocator, the support surface including a first groove and a second groove formed therein, the first groove extending along a second direction intersecting with the first direction and being configured to transfer the lubricating oil to the second groove, the first groove having a first end and a second end, the first end and the second end reaching a contour of the support surface, and the second groove extending from a center of the first groove toward the compression chamber along the first direction.

2. The rotary compressor according to claim 1, wherein the first groove is configured to acquire the lubricating oil from both the first end and the second end.

3. The rotary compressor according to claim 2, wherein the second groove has a third end adjacent to the compression chamber and a fourth end spaced from the compression chamber, and the third end is separated from the contour of the support surface.

4. The rotary compressor according to claim 3, wherein the second groove is configured to acquire the lubricating oil from the fourth end.

5. The rotary compressor according to claim 2, wherein the first groove has a first width that is at least 1/20 of a first length of a first side of the support surface extending in the first direction, or the second groove has a second width that is at least 1/40 of a second length of a second side of the support surface extending in the second direction.

6. The rotary compressor according to claim 1, wherein the first groove has a first width that is at least 1/20 of a first length of a first side of the support surface extending in the first direction, or the second groove has a second width that is at least 1/40 of a second length of a second side of the support surface extending in the second direction.

7. The rotary compressor according to claim 1, wherein the first groove and the second groove have a groove area on the support surface, and the groove area is at least 1/50 of a support surface area of the support surface.

8. The rotary compressor according to claim 1, wherein the compression mechanism includes a cylinder, a piston, and a vane, the piston is configured to be in contact with the cylinder, and to move, the piston having a cylindrical shape, the vane defines the compression chamber in cooperation with the cylinder and the piston, and the reciprocator is the vane.

9. The rotary compressor according to claim 8, wherein the vane is formed integrally with the piston.

10. The rotary compressor according to claim 8, wherein the vane is formed separately from the piston.

11. The rotary compressor according to claim 1, wherein the second groove has a third end adjacent to the compression chamber and a fourth end spaced from the compression chamber, and the third end is separated from the contour of the support surface.

12. The rotary compressor according to claim 11, wherein the second groove is configured to acquire the lubricating oil from the fourth end.

13. An air conditioner including the rotary compressor according to claim 1.

14. A rotary compressor comprising:

a casing including an oil reservoir configured to store lubricating oil inside; and a compression mechanism including a reciprocator and a support, the reciprocator defining a compression chamber and reciprocating along a first direction, the support having a support surface configured to support the reciprocator, the support surface including a first groove and a second groove formed therein, the first groove extending along a second direction intersecting with the first direction and being configured to transfer the lubricating oil to the second groove, the second groove extending from a center of the first groove toward the compression chamber along the first direction, the second groove having a third end adjacent to the compression chamber and a fourth end spaced from the compression chamber, and the third end is being separated from the contour of the support surface.

15. The rotary compressor according to claim 14, wherein the second groove is configured to acquire the lubricating oil from the fourth end.

16. The rotary compressor according to claim 14, wherein the support surface includes a branch groove extending from the third end in the second direction.

17. The rotary compressor according to claim 16, wherein the first direction and the branch groove form an acute angle ($\alpha$, $\beta$).

18. A rotary compressor comprising:

a casing including an oil reservoir configured to store lubricating oil inside; and a compression mechanism including a reciprocator and a support, the reciprocator defining a compression chamber and reciprocating along a first direction, the support having a support surface configured to support the reciprocator, the support surface including a first groove and a plurality of second grooves formed therein, the first groove extending along a second direction intersecting with the first direction and being configured to transfer the lubricating oil to the plurality of second grooves, and the plurality of second grooves extending from the first groove toward the compression chamber along the first direction.

* * * * *